US008087528B1

(12) United States Patent
Scarlett et al.

(10) Patent No.: US 8,087,528 B1
(45) Date of Patent: Jan. 3, 2012

(54) STABILIZER CUP HOLDER

(76) Inventors: Elizabeth Scarlett, Sarasota, FL (US); Pamela Coutant, Winter Park, FL (US)

( * ) Notice: Subject to any disclaimer, the term of this patent is extended or adjusted under 35 U.S.C. 154(b) by 956 days.

(21) Appl. No.: 12/011,591

(22) Filed: Jan. 28, 2008

(51) Int. Cl.
*B65D 21/02* (2006.01)
*B65D 3/28* (2006.01)

(52) U.S. Cl. ..... 220/23.89; 220/737

(58) Field of Classification Search ..... 248/311.2, 248/154, 146; 220/738, 737, 23.89; 211/74
See application file for complete search history.

(56) References Cited

U.S. PATENT DOCUMENTS

| | | | | | |
|---|---|---|---|---|---|
| 558,433 | A | * | 4/1896 | Stoddard | 248/152 |
| D99,857 | S | | 6/1936 | Fisher | |
| 2,589,967 | A | * | 3/1952 | Sawyer | 215/376 |
| 2,784,577 | A | * | 3/1957 | Beaham | 248/146 |
| 3,028,702 | A | | 4/1962 | St. Cyr | |
| 3,096,960 | A | * | 7/1963 | Kinney | 248/113 |
| 3,168,341 | A | | 2/1965 | Beaudet | |
| 3,285,456 | A | * | 11/1966 | Pewitt | 215/395 |
| 3,302,428 | A | * | 2/1967 | Paquin et al. | 62/457.4 |
| 3,338,390 | A | * | 8/1967 | Gordon | 206/306 |
| 3,918,920 | A | * | 11/1975 | Barber | 422/560 |
| 3,941,237 | A | | 3/1976 | MacGregor, Jr. | |
| 4,116,353 | A | * | 9/1978 | Schwabacher | 215/274 |
| 4,726,553 | A | * | 2/1988 | Wischusen, III | 248/146 |
| 4,747,507 | A | * | 5/1988 | Fitzgerald et al. | 220/739 |
| 5,014,868 | A | * | 5/1991 | Wittig et al. | 220/737 |
| 5,060,899 | A | | 10/1991 | Lorence et al. | |
| 5,071,096 | A | * | 12/1991 | Hartmann et al. | 248/154 |
| D330,995 | S | | 11/1992 | Hartman et al. | |
| 5,316,146 | A | | 5/1994 | Graff | |
| 5,590,782 | A | | 1/1997 | Haber et al. | |
| D383,271 | S | * | 9/1997 | Eshelman | D32/54 |
| 5,782,448 | A | | 7/1998 | Withun et al. | |
| 5,897,090 | A | | 4/1999 | Smith et al. | |
| 6,039,206 | A | | 3/2000 | DeFrancesco | |
| 6,050,468 | A | | 4/2000 | Kelley | |
| 6,361,008 | B1 | | 3/2002 | Gravenstreter | |
| 6,705,580 | B1 | | 3/2004 | Bain | |
| 6,941,601 | B2 | | 9/2005 | DeBartolo et al. | |
| D516,872 | S | | 3/2006 | Rigberg et al. | |
| 7,574,846 | B2 | * | 8/2009 | Sheets et al. | 53/440 |
| 7,731,144 | B2 | * | 6/2010 | Kazyaka | 248/311.2 |
| 2004/0021048 | A1 | | 2/2004 | Schaal | |
| 2004/0118860 | A1 | | 6/2004 | Leopold et al. | |
| 2006/0081750 | A1 | * | 4/2006 | Kazyaka | 248/311.2 |
| 2006/0113200 | A1 | | 6/2006 | Abkarian et al. | |

* cited by examiner

*Primary Examiner* — J. Gregory Pickett
*Assistant Examiner* — Kaushikkumar Desai
(74) *Attorney, Agent, or Firm* — D. Scott Hemingway; Hemingway & Hansen, LLP

(57) ABSTRACT

The invention is a beverage container holder sized to secure a beverage container with a variance in diameters, with frictional fin appendages securing the beverage container in the cup holder. The holder is composed of a soft, flexible, non-slip material. The holder is surrounded by a stabilizer to enhance stability and protect from liquid spills. The bottom is also textured to provide a sticky surface that does not readily slip over flat surfaces.

10 Claims, 2 Drawing Sheets

STABILIZER CUP HOLDER

TECHNICAL FIELD OF THE INVENTION

A beverage cup holder featuring a stabilizer around the base.

BACKGROUND OF THE INVENTION

Cup holders are exterior container receptacles appropriately sized to receive the base of a cup, beaker, glass, can, or similar beverage container. Many people use cup holders to protect furniture, upholstered surfaces, and carpeted surfaces from spills. Cup holders are a car accessory and several prior art designs are intended for use in homes or similar settings.

Children present increased risks when drinking from a beverage container. Children often tip beverages over, thereby causing spills. Prior art cup holders are generally sized to accommodate soda cans and beverage containers of approximately the same size. These prior art cup holders are not sized to accommodate the cup sizes typically used by young children. Such cup holders also lack a means of providing enhanced stability and guarding from tip-over spills, which frequently occur with children. There is a need for an improved cup holder that can accommodate various sized cups and glasses and provide enhanced protection from spills. Such holders would be useful in dining or craft activity in a home, school, daycare, or medical situation.

SUMMARY OF THE INVENTION

The invention is a cup holder capable of accommodating various cup sizes frequently used by children and providing enhanced stability and protecting from spills. The cup holder consists of a central cylindrical structure with protruding, resilient friction fins that will grip the sides of an inserted glass or other beverage container. The friction fins maintain a flexible friction contact, but also provide a variance in the size of cups that can be securely placed in the cup holder. Beverage containers inserted into the holder press against the fins so as to accommodate varying cup sizes, while still providing a friction grip to help retain the beverage container.

Around the base of the holder is a stabilizer designed to help catch liquid spills from the container and provide stability of the holder. This stabilizer can be formed in a decorative fashion, and various configurations are possible. As an alternate embodiment, the bottom portion extending laterally from the base of the stabilizer can include a raised lip to enhance liquid spill protection and leakage. The bottom of the container is textured to provide a non-slick bottom surface, creating frictional forces with the surface supporting the cup holder. This frictional bottom surface keeps the holder from sliding over solid, smooth surfaces. The holder is made from silicone, rubber, or similar flexible, non-slip material.

BRIEF DESCRIPTION OF THE DRAWINGS

The objects and features of the invention will become more readily understood from the following detailed description and appended claims when read in conjunction with the accompanying drawings in which like numerals represent like elements and in which:

DESCRIPTION OF THE PREFERRED EMBODIMENTS

Figures 1, 2, 3:
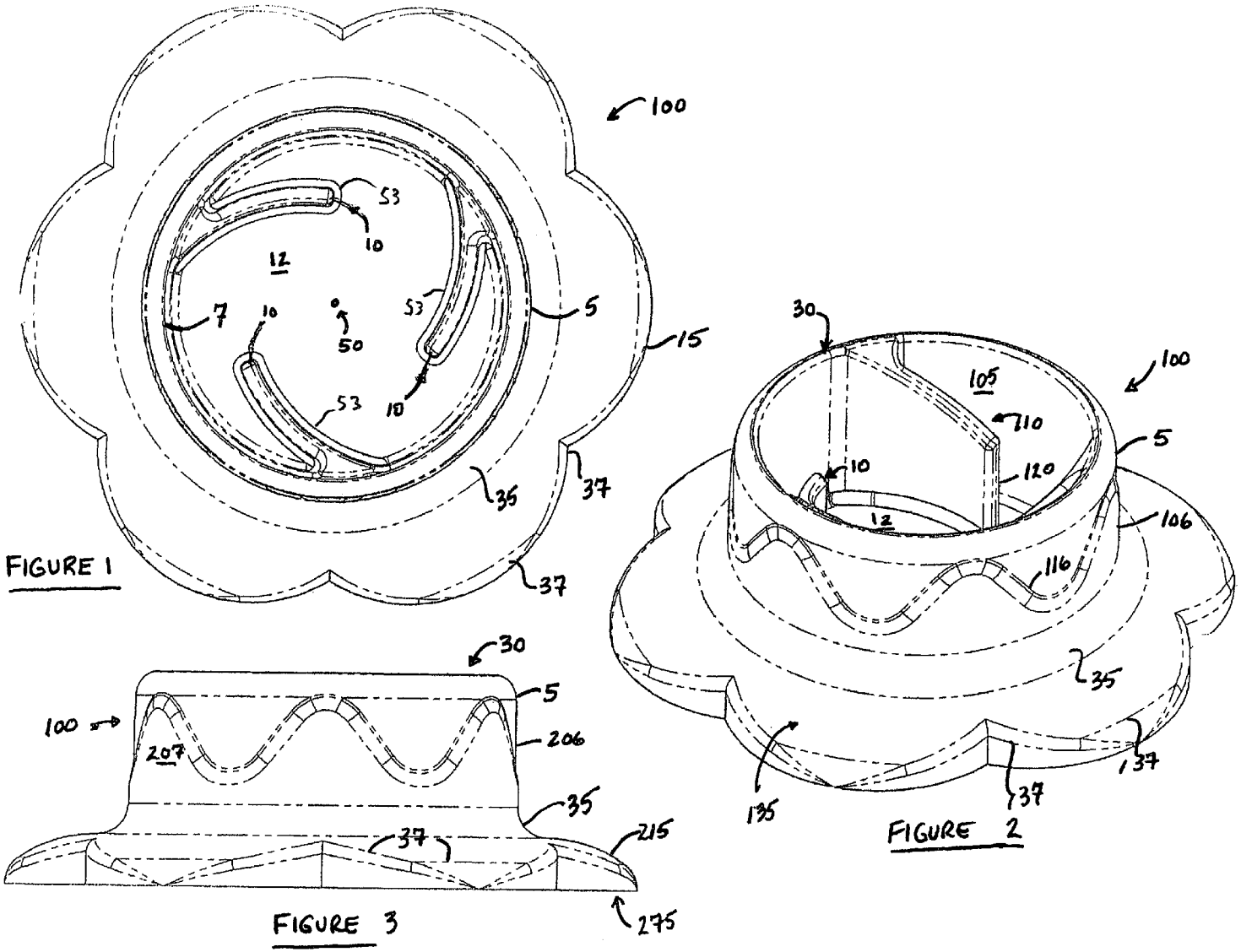
FIG. 1 is an overhead view of a first embodiment of the holder.
FIG. 2 is a perspective view of a first embodiment of the holder.
FIG. 3 is a side view of a first embodiment of the holder.

FIG. 1 shows an overhead view of the cup holder 100 in a first embodiment. The cup holder 100 is constructed from silicone, silicone-based, rubber, or similar soft, flexible, rubberized non-slip material. The most prominent feature of the cup holder is the cylindrical central structure 5 sized for receiving a predetermined sized cup. Different sized cups can be accommodated based on the size of the central structure 5 of cup holder 100 and the size and shape of the frictional fins 10 protruding inwardly in the cup holder. Inserts can also be placed inside the cup holder to securely hold a smaller cup than otherwise held by cup holder as sized by the fins 10.

Extending from the inner side 7 of the cylinder 5 toward a point offset from the center 50 are resilient, flexible fins 10 to grip the sides of the inserted beverage containers. Three flexible fins 10 are shown, but one or more fins 10 can be used and are contemplated by the present invention. The fins 10 allow for a variance of cup sizes to be maintained in the cup holder. Other shapes are possible to grip the sides of any inserted beverage containers. The cylinder 5 has a closed base 12 opposite from an open top 30 into which a cup is inserted. The closed base 12 has cutouts or slits 53 directly under the fins 10. These cutouts 53 enhance manufacture of the cup holder 100 and leave the fins 10 free to move. The fins 10 are not in contact with the closed base 12, and the cutouts 53 enable simpler and less expensive molding and finishing. As an alternative embodiment, fins can contact the closed base or the base may be open with retaining tabs supporting the bottom of the drink container.

Extending from the bottom of the center cylinder 5 is a scalloped base that is a stabilizer 15 intended to catch small quantities of inadvertently spilled liquid beverage or condensation, both of which would leak over the outer surface of the cup holder. Also, this base can provide a decorative element to the holder. Different shapes for the stabilizer are possible, such as round, circular, star-shaped, square, or rectangular. The stabilizer 15 adds to stability of the cup holder when it is resting on a flat surface by extending horizontally at the lower portion of the cup holder 35. Surrounding the base or stabilizer 15 is a tapering or sloping lip 37 that helps stiffen and strengthen the stabilizer 15 to retain its shape. Alternatively, a raised lip can replace the sloping lip and provide increased spill protection in another embodiment. The stabilizer 15 has a series of rounded, semi-circular appurtenances 37 forming the outer edge, but other configurations are possible in other embodiments.

FIG. 2 is a perspective view of the first embodiment of the cup holder 100. The inner side 105 of the cylindrical center structure 5 has frictional fins 110 extending from the inner side 105 toward a point offset from the center. These fins can possess a straight vertical contact edge 120 or a tapered edge wider toward the bottom of cup holder—to allow easy entry of the beverage container into the cup holder 100 and a more secure fit if the cup holder 100 tips over. The outer side 106 of the center structure 5 includes a surrounding raised decorative strip 116. The decorative strip 116 also helps strengthen and stiffen the center structure 5. Other shapes and sizes of strengthening strips are possible. The scalloped stabilizer 135 extends from the closed base or end 12 of the center structure to form the base of the cup holder and provide a stable platform and includes a sloping lip 137. The sloping lip 137 assists in catching liquid spills and stiffens and strengthens the stabilizer 135.

FIG. 3 is a side view of the first embodiment of the cup holder 100. The outer side 206 of the cylindrical center structure is embossed with a surrounding decorative strip 207. The decorative strip 207 helps stiffen and strengthen the center structure, and other embodiments of decorative and strengthening structural elements to strengthen and stiffen the center structure are possible. Different materials such as metal or varying plastic or rubber materials can also be used. A scalloped stabilizer 215 forms the base of the cup holder to enhance protection from spills and stability of the holder 100, and includes a sloping lip 37. The sloping lip 37 aids in catching liquid spills and stiffens and strengthens the stabilizer 215. The bottom surface 225 of the cup holder 100 is slightly textured and creates a sticky bottom because of material used to make the cup holder. The resulting friction forces keep the holder from freely sliding over smooth flat surfaces.

Figure 4:
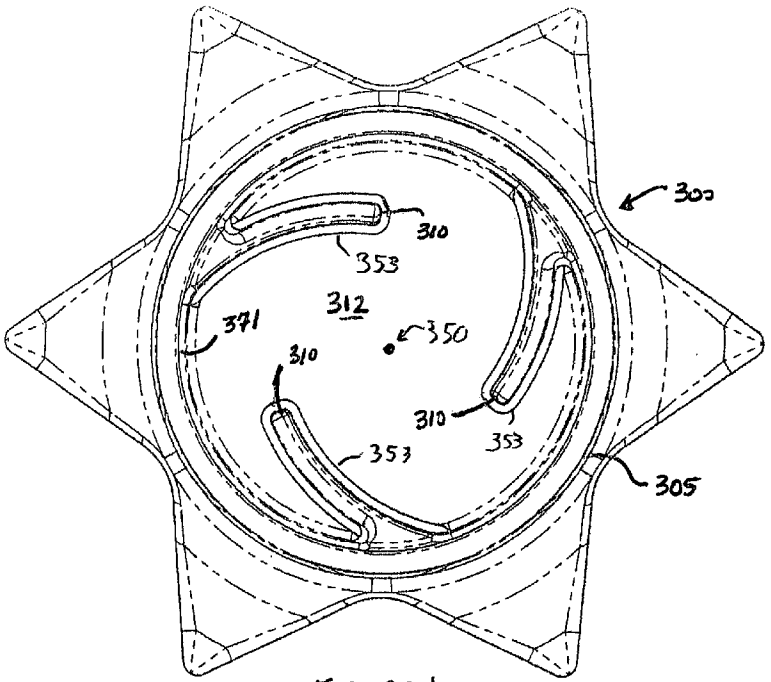
FIG. 4 is an overhead view of a second embodiment of the holder.

FIG. 4 shows an overhead view of the cup holder 300 in the second embodiment. The most prominent feature of the cup holder 300 is the cylindrical central structure 305 sized for receiving a predetermined sized cup. Different sized cups can be accommodated based on the size of the cup holder 300. Inserts can be placed inside the cup holder to severely hold a smaller cup than otherwise held by cup holder 300.

Extending from the inner side 371 of the cylinder 305 toward a point offset from the center are resilient, flexible fins 310 to grip the sides of an inserted beverage containers. Three flexible fins 310 are shown, but one or more fins 310 can be used and are contemplated by the present invention. The fins 310 allow for a variance of cup sizes to be maintained in the cup holder. Other shapes are possible to grip the sides of any inserted beverage containers. The cylinder 305 has a closed base 312 opposite from an open top 372 into which a beverage container is inserted. The closed base 312 has a center point 350 and cutouts or slits 353 directly under the fins 310. These cutouts 353 enhance manufacture of the cup holder 300 and leave the fins free to move. The fins 310 are not in contact with the closed base 312, and the cutouts 352 enable simpler and less expensive molding and finishing. As an alternative embodiment, the fins can touch the closed base or the base may be open with retaining tabs used to support the drink containers.

Extending from the bottom of the center cylinder 305 is a star-shaped base that is a stabilizer 315 intended to catch small quantities of inadvertently spilled liquid beverage or condensation, both of which would leak over the outer surface of the cup holder 300. Also, this base can provide a decorative element to the holder. Different shapes for the stabilizer 312 are possible, such as round, circular, star-shaped, square, or rectangular. The stabilizer 315 adds to stability of the cup holder when it is resting on a flat surface by extending horizontally at the lower portion of the cup holder. Surrounding the base or stabilizer 315 is a tapering or sloping lip 320 that helps stiffen and strengthen the stabilizer 315 to retain its shape. Alternatively, a raised lip can replace the sloping lip and provide increased spill protection in another embodiment. The stabilizer 320 in this embodiment has a series of star-shaped appurtenances, but other configurations are possible.

Figure 5:
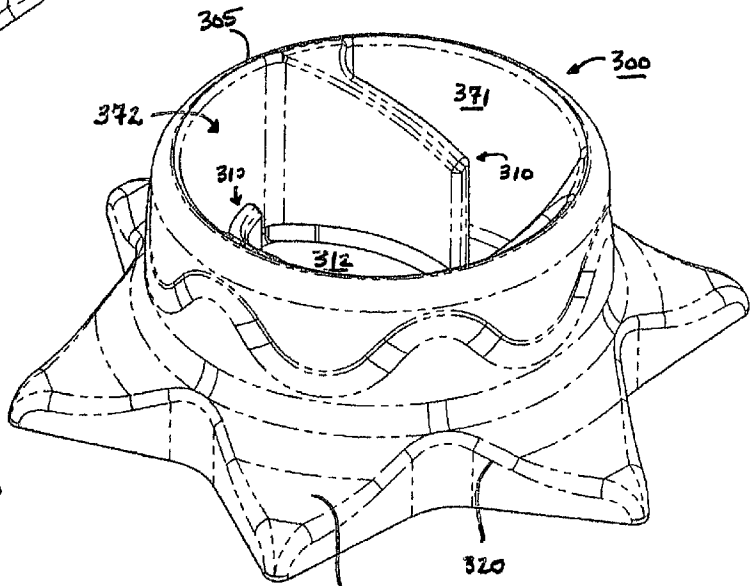
FIG. 5 is a perspective view of a second embodiment of the holder.

FIG. 5 is a perspective view of the second embodiment of the cup holder 300. The inner side 371 of the cylindrical center 305 has frictional fins 310 extending from the inner side 305 toward a point offset from the center. These fins 310 can possess a straight vertical contact edge or a tapered edge wider toward the bottom of cup holder 312—to allow easy entry of the beverage container into the cup holder 305 and a more secure fit if the cup holder 300 tips over. The outer side 306 of the center structure includes a raised surrounding decorative strip 307. The decorative strip 307 helps stiffen and strengthen the center structure 305, and other embodiments of decorative structural elements to strengthen and stiffen the center structure 305 are possible. The star-shaped stabilizer 315 forms the base of the cup holder 300 to provide a stable platform and includes a sloping lip 320. The sloping lip 320 aids in catching liquid spills and stiffens and strengthens the stabilizer 315.

Figure 6:
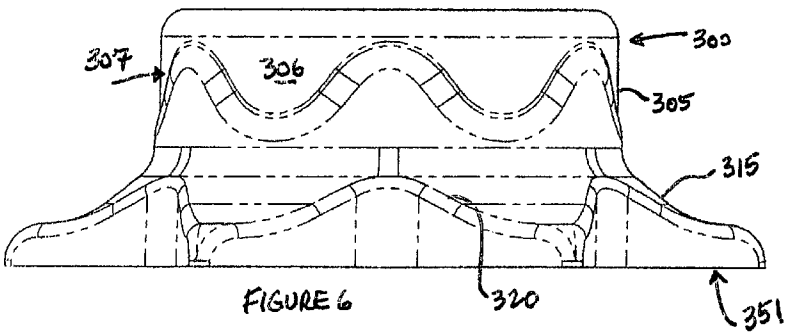
FIG. 6 is a side view of a first embodiment of the holder.

FIG. 6 is a side view of the second embodiment of the cup holder. The outer side 306 of the cylindrical center structure is embossed with a surrounding raised decorative strip 307. The decorative strip 307 helps strengthen and stiffen the center structure 305, and other embodiments of decorative structural elements to strengthen and stiffen the center structure 305 are possible. A star-shaped stabilizer 315 forms the base of the cup holder and includes a sloping lip 320. The sloping lip 320 aids in retaining liquid spills and stiffens and strengthens the stabilizer 315 as well as providing a stable platform. The bottom 351 of the cup holder 300 is slightly textured and creates a sticky bottom 351 because of material used to make the cup holder 300. The resulting friction forces keep the holder from freely sliding over flat surfaces.

While the invention has been particularly shown and described with respect to preferred embodiments, it will be readily understood that minor changes in the details of the invention may be made without departing from the spirit of the invention. Having described the invention.

We claim:

1. A cup holder for holding a beverage container, comprising:

a cylindrical central holding structure with an open top and a closed base, an inner surface and an outer surface, one or more flexible resilient fin appendages extending from the inner surface of the cylindrical central holding structure inwardly towards a free end, with the free end offset from a vertical line of the holding structure, such that the flexible resilient fin appendages can be frictionally attached to said beverage container and flexible enough to securely hold said beverage containers of different sizes at different times without modification of the resilient fin appendages, said one or more flexible resilient fin appendages having a tapered vertical contact edge with the free end wider near the closed base than the open top, and said tapered vertical contact edge extending substantially from the open top to the closed base of the cylindrical central holding structure;

a stabilizer extending from and surrounding the closed base of the cylindrical central holding structure, said stabilizer having a horizontal flat surface that extends laterally around the closed base and having an edge located on a perimeter of the horizontal flat surface and having an exterior lip that extends vertically upward at the edge of the horizontal flat surface on the stabilizer; and a textured surface on the bottom surface of a closed base to reduce slippage of the cup holder.

2. The cup holder for holding a beverage container of claim 1, wherein there are a plurality of flexible resilient fin appendages are sized to securely hold a beverage container intended for use by young children.

3. The cup holder for holding a beverage container of claim 1, wherein the cup holder is constructed of a soft, flexible, non-slip material.

4. The cup holder for holding a beverage container of claim 3, wherein the cup holder is constructed from silicone material.

5. The cup holder for holding a beverage container of claim 3, wherein the cup holder is constructed from a textured silicone-based material.

6. The cup holder for holding a beverage container of claim 1, wherein one or more flexible resilient fin appendages has a vertically aligned contact edge.

7. A cup holder for holding a beverage container, comprising:

a central cylindrical holding structure with an open top and a closed base, an inner surface and an outer surface, one or more flexible resilient fin appendages extending from the inner surface of the central cylindrical holding structure inwardly towards a free end, with the free end offset from a vertical line of the central cylindrical holding structure, such that the flexible resilient appendages can be frictionally attached to said beverage container and flexible enough to securely hold different beverage container sizes at different times without modifying the flexible resilient fin appendages, said one or more flexible resilient fin appendages having a tapered vertical contact edge with the free end wider near the closed base than the open top, said tapered vertical contact edge extends substantially from the open top to the closed base of the cylindrical central holding structure;

a stabilizer extending horizontally from and surrounding the closed base of the cylindrical central structure, said stabilizer having a horizontal flat surface that extends laterally around the closed base and having an edge located on a perimeter of the horizontal flat surface defined outside a perimeter of the closed base, said edge retaining spilled liquid from the beverages container; and a textured surface on the bottom surface of the closed base to reduce slippage of the cup holder.

8. The cup holder for holding a beverage container of claim 7, wherein the cup holder is constructed of a soft, flexible, non-slip material.

9. The cup holder for holding a beverage container of claim 7, wherein one or more flexible resilient fin appendages has a vertically aligned contact edge.

10. The cup holder for holding a beverage container of claim 7, wherein the stabilizer possesses a surrounding raised vertical lip on the edge of the horizontal surface.

* * * * *